US006955615B1

(12) United States Patent
Cavell

(10) Patent No.: US 6,955,615 B1
(45) Date of Patent: Oct. 18, 2005

(54) PITCHER SCREEN

(76) Inventor: Bruce G. Cavell, P.O. Box 525, North Webster, IN (US) 46555

( * ) Notice: Subject to any disclaimer, the term of this patent is extended or adjusted under 35 U.S.C. 154(b) by 0 days.

(21) Appl. No.: 10/366,976

(22) Filed: Feb. 14, 2003

(51) Int. Cl.[7] ..... A63B 69/00
(52) U.S. Cl. ..... 473/451; 473/454
(58) Field of Search ..... 473/421, 422, 473/415, 446, 470–475, 491–494, 451; 273/348, 273/402, 403, 407, 410; D21/699–706; D6/552; D3/221

(56) References Cited

U.S. PATENT DOCUMENTS 3,371,950 A * 3/1968 Stap ..... 294/15
3,893,669 A * 7/1975 Myers ..... 473/418
4,046,284 A * 9/1977 Samuelsson ..... 221/45
4,057,252 A * 11/1977 Pelton ..... 273/400
4,489,941 A * 12/1984 Shieh ..... 473/197
4,629,065 A * 12/1986 Braaten ..... 206/315.1
5,462,328 A * 10/1995 Chandler et al. ..... 294/143
5,639,243 A * 6/1997 Ryan et al. ..... 473/451
5,823,360 A * 10/1998 Gorosave ..... 211/13.1
6,694,994 B1 * 2/2004 Zheng ..... 135/126

FOREIGN PATENT DOCUMENTS

FR 2722417 A1 * 1/1996 ..... A63B 69/00

OTHER PUBLICATIONS

Tomark Sports Catalog for Baseball and Softball; 2002; pp. 47 and 48.*
Baseball Express All Baseball All the Time, Fall 2002, B, p. 20, Baseball Express, San Antonio, TX.

* cited by examiner

*Primary Examiner*—Mitra Aryanpour
(74) *Attorney, Agent, or Firm*—Krieg DeVault Lundy LLP

(57) ABSTRACT

A pitcher's screen comprising a lower screen having opposite ends and a base secured to the lower screen. An upper screen is pivotally connected to the lower screen midway between the ends. The upper screen is movable in relation to the lower screen adjacent one of the ends and in the same plane as the lower screen adjacent the other ends and in the same plane as the lower screen. A ball basket removably connected to the lower screen remote from the upper screen whereby both left handed and right handed pitchers may be protected during batting practice without moving the base and the balls and may be conveniently stored.

24 Claims, 3 Drawing Sheets

PITCHER SCREEN

DESCRIPTION OF A SPECIFIC EMBODIMENT

Figure 1:
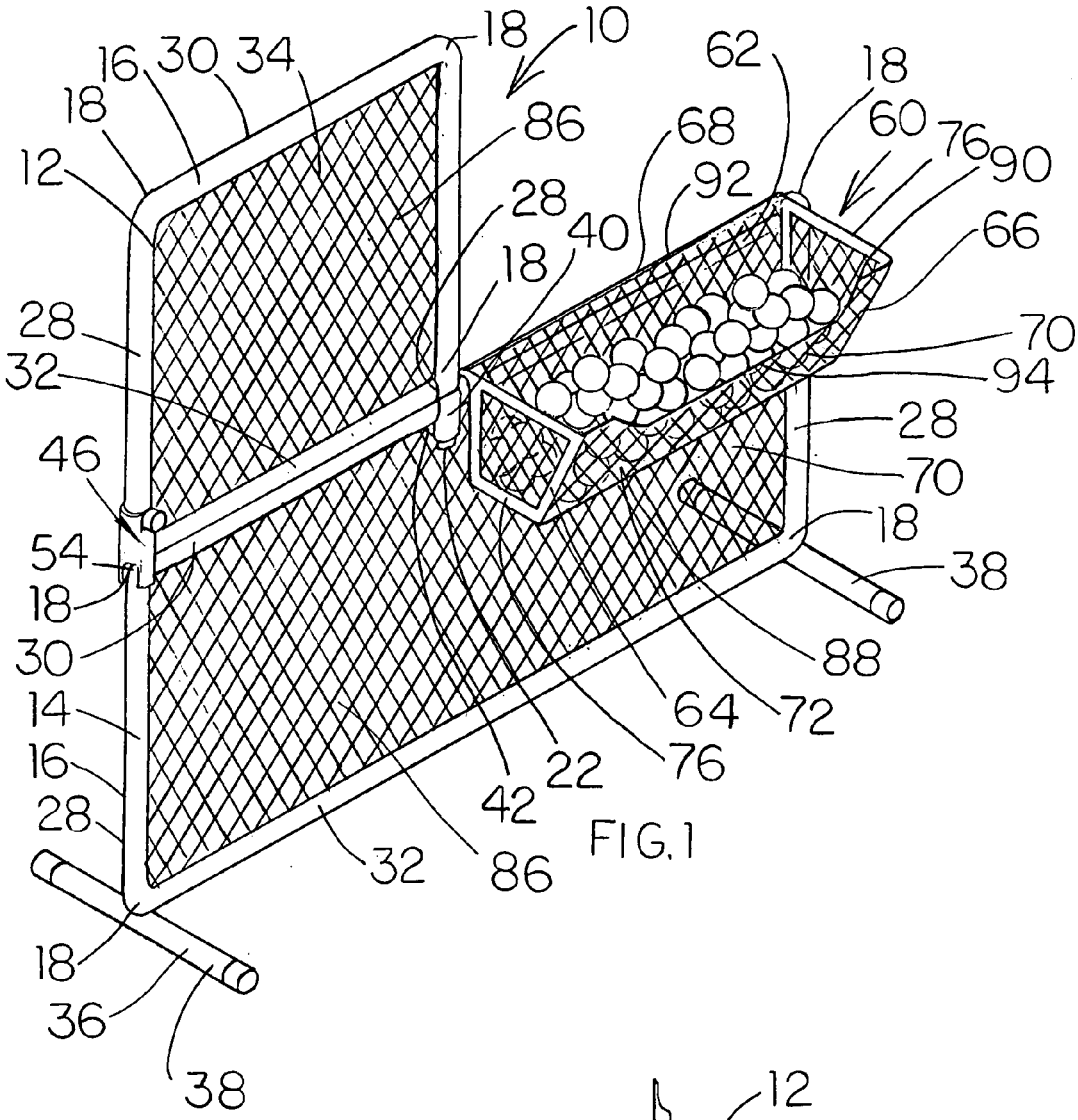
FIG. 1 is a perspective view of the new and improved pitcher screen of the invention showing the upper screen in its right hand pitching position.

The new and improved pitcher screen 10 of the invention provides pitchers with protection from batted balls during batting practice. Screen 10 has an upper screen 12 and a lower screen 14. The upper screen 12 is pivotally connected to the lower screen 14 such that the upper screen 12 may be selectively positioned with regard to the lower screen 14 to provide protection for both right handed and left handed pitchers.

Both upper screen 12 and lower screen 14 have an elongated peripheral metal member 16. The metal member 16 is bent at four spaced apart corners 18 and is joined at the opposite ends 20 and 22 to enclose a generally rectangular space therebetween. In a specific embodiment, member 16 may be a tubular member or beam and the opposite ends may be joined by a connector 24 in which the opposite ends 20, 22 either telescope into or onto or overlap connector 24 and member 16 are joined thereto by fasteners or by welding or the like. In a specific embodiment the fasteners may include screws, bolts, detents or any other fastener as may be deemed desirable by those persons skilled in the art. In other specific embodiments, member 16 may be any beam of any convention or construction. In specific embodiments, the member 16 may be galvanized steel, stainless steel, plastic, or aluminum tubing or beam as may be desired. Each screen 12, 14 as constructed has opposite ends 28, a top 30 and a bottom 32.

Spanning each screen 12, 14 and extending between the ends 28, the top 30 and the bottom 32 and covering the entire space therebetween is a screen 34. Screen 34 is secured to member 16 at its periphery. Screen 34 may be secured to the member 16 by a plurality of spaced apart fasteners, or by welding or the like. In a specific embodiment, screen 34 may be window screen, wire cloth, chain link fencing, expanded metal, plastic screen, twine netting, or any other available metal, or plastic, or twine screens of the same or similar materials which provide some flexibility between ends 28 and top 30 and bottom 32 when secured to the member 16 of upper screen 12 and lower screen 14 and are sufficiently resistant to corrosion when exposed to the weather. Sufficient flexibility is desirably provided in either the screen 34 or the manner in which the screens 12, 14 are supported such that when batted balls impact the screen 34, the flexibility of the screen absorbs the velocity of the ball and the ball drops to the ground in the vicinity of the screen 34.

A base 36 is secured to the bottom 32 of lower screen 14 to provide means for supporting the screen 10 in a generally vertical and upright position. In the simplest form, base 32 may be a plurality of elongated members 38 secured to the bottom 32 of lower screen 14 so as to extend generally perpendicularly thereof outwardly on opposite sides of the lower screen 14. In specific embodiments, these rigid members 38 may be tubular or have cross-sections or cross-sections of any of the conventional structural beams. In specific embodiments, these members 38, like members 16 may be made of galvanized steel, stainless steel, plastic, aluminum or any other materials which are deemed suitable to persons skilled in the art.

Figure 3:
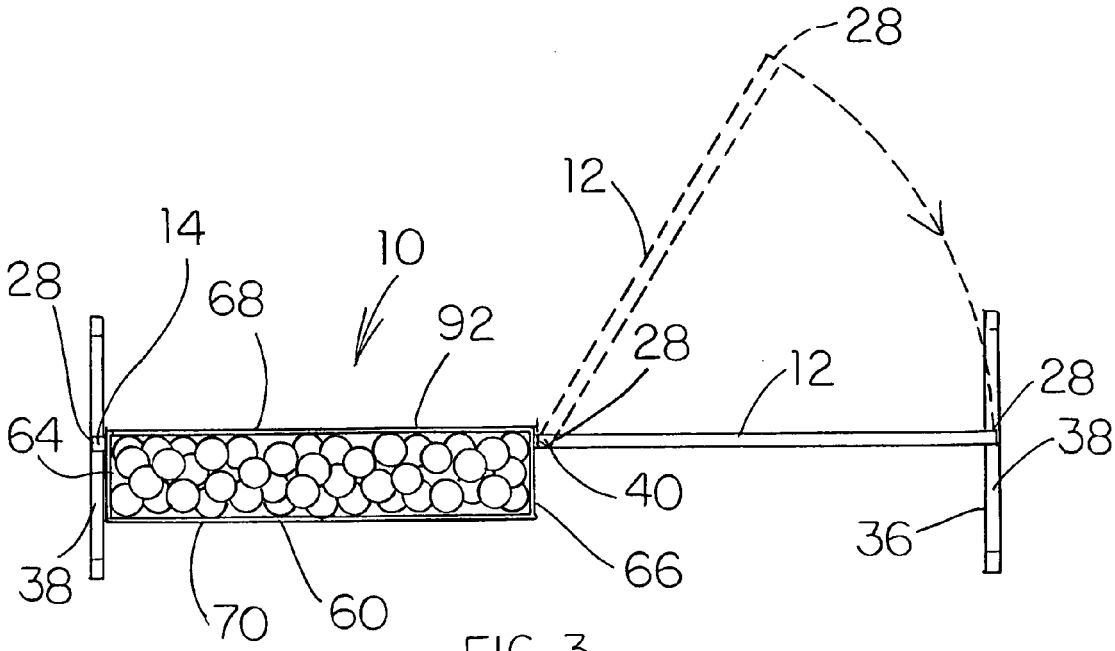
FIG. 3 is a top view of the new and improved pitcher screen of the invention showing the upper screen in its left hand pitching position in solid lines and in an intermediate position in dashed lines.
Figure 4:
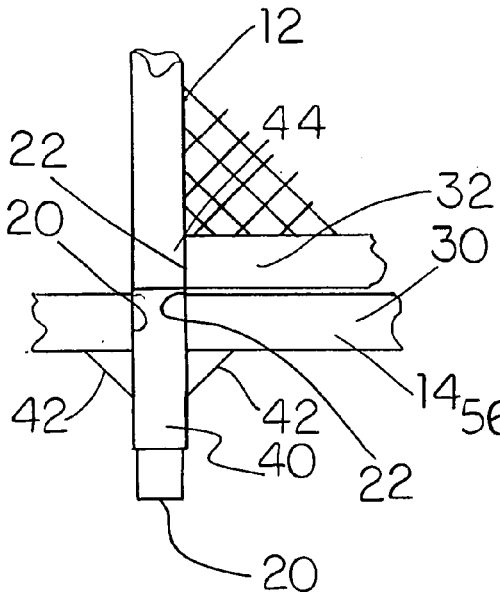
FIG. 4 is a fragmentary view of one embodiment of the pivotal connection between the upper screen and the lower screen of the new and improved pitcher screen of the invention.

Upper screen 12 is pivotally connected to lower screen 14 at its top 30 midway between opposite ends 28. Referring to FIG. 4, one means by which the upper screen may be pivotally connected to lower screen 14 will be described. Lower screen 14 is provided with a tubular bushing 40 which is secured to the lower screen at the opposite ends 20, 22 of member 16 by welding. Bushing 40 is generally flush with the exterior surface of the tubing 16 and extends downwardly into the interior of the lower screen 14. The bushing 40 may be further secured to the lower frame 14 by a plurality of braces 42 extending between the member 16 and the bushing 40. Bushing 40 is provided in a size to receive therein in telescopic fashion a portion of member 16 of upper screen 12 adjacent end 20 which in this embodiment is tubing or rod. As shown in FIG. 4, end 20 of member 16 of upper screen 12 extends downwardly from the bottom 32 of upper screen 12. The other end 22 of member 16 of upper screen 12 is secured to the member 16 at a position 44 spaced from end 20 as shown in FIG. 4. Member 16 adjacent end 20 thus may rotate within the bushing 40 and be supported therein so as to support upper screen 12 above lower screen 14 and to be able to allow for rotation between upper screen 12 and lower screen 14 to position both screens 12, 14 in the same plane on opposite sides of the bushing 40 as shown in FIGS. 1 and 3. In this specific embodiment, member 16 may be galvanized steel tubing or rod, stainless steel tubing or rod, plastic tubing or rod, aluminum tubing or rod or any other readily available tubing having a diameter from about ¾ of an inch to about 2 inches in diameter. Bushing 40 may be like tubing with a diameter at least ¼ inch larger than member 16. In another specific embodiment, the member 16 is provided as metal tubing and the bushing 40 is provided in tubing of high density polyethylene or another bearing material.

Figure 5:
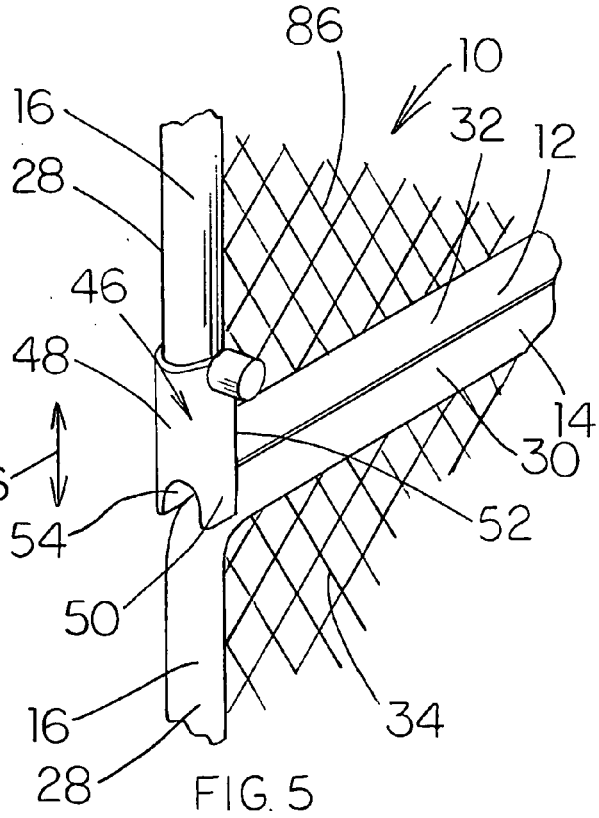
FIG. 5 is a fragmentary perspective view of the latch by which the upper screen is held in its desired position relative to the lower screen when the new and improved pitcher screen of the invention is being used.

Referring to FIG. 5, the latch 46 which holds the upper screen 12 and lower screen 14 in position is shown. Latch 46 is shown to have an upper tubular portion 48 which surrounds the lower portion of the moveable end of member 16 of upper screen 12 and a lower portion 50 which surrounds top 30 of lower screen 14. Upper portion 48 has a longitudinal slot 52 extending the entire length of portion 48 in which screen 34 of upper screen 12 is positioned. Lower portion 50 has a slot 54 extending transversely of slot 54 in which member 16 of top 30 of lower screen 14 is positioned when desired. Tubular portion 48 of latch 46 may be slid up and down on member 16 as suggested by arrow 56 so as to remove member 16 of top 30 of lower screen 14 from slot 54 and to allow upper screen 12 to be moved about its pivotal connection when desired. When upper screen 12 is positioned with respect to lower screen 14 as desired, latch 46 can be lowered by gravity onto member 16 of top 30 of lower screen 14 so as to hold upper screen 12 and lower screen 14 in its desired position.

Figure 6:
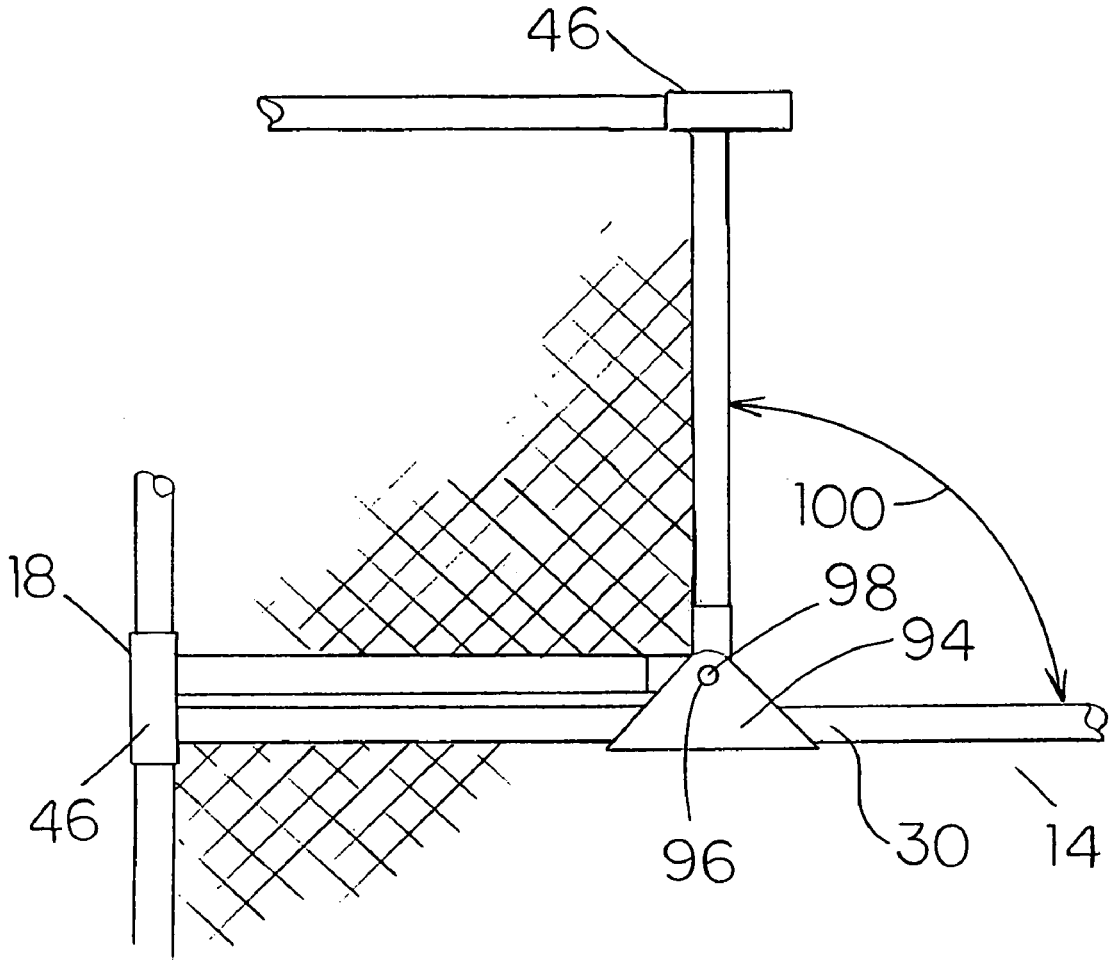
FIG. 6 is a fragmentary perspective view of a second embodiment of the pivotal connection between the upper screen and the lower screen of the new and improved pitcher screen of the invention.

Referring to FIG. 6, there is provided an alternate means by which upper screen 12 is pivotally connected to lower screen 14 at its top 30 midway between opposite ends 28. Lower screen 14 is provided with a pair of brackets 94 secured to top 30 generally midway between the opposite ends 28. Each bracket 94 has a bushing 96 therein in which a pivot rod 98 is supported. Pivot rod 98 extends transversely of screen 14 and top 30 midway between the opposite ends 28. Pivot rod 98 is secured to one corner 18 of the member 16 of the upper screen 12 as shown in FIG. 6. Adjacent to the other two adjacent corners 18, are latches 54 as illustrated in FIG. 5 and above described.

By the pivot pin secured to upper screen 12 and mounted in the bushings 96 of brackets 94 secured to top 30 of the lower screen 14, the entire upper screen 12 may pivotally rotate about pivot 98 from the position shown in FIG. 1 to the position shown in FIG. 3 as indicated by arrow 100. In this specific embodiment, upper screen 12 and lower screen 14 can have member 16 be of galvanized steel tubing or rod, stainless steel tubing or rod, plastic tubing or rod, aluminum tubing or rod, or any other readily available tooling having diameter from about ¾ inch to about 2 inches. Brackets 94 may be made of galvanized steel, stainless steel, or aluminum sheet material. Pivot rod 98 may be of steel or plastic or aluminum rod suitable to carry the load of upper screen 12.

By the pivotal connection between upper screen 12 and lower screen 14 as shown in FIGS. 4 and 6 and the latch shown in FIG. 5, upper screen 12 can be moved from the position illustrated in FIG. 1 for right handed batters to a position in which the upper screen 12 is pivoted 180° so as to be positioned for left handed batters as suggested by FIG. 3. In both positions, the screen 12 may be secured in position by the latch 46 as illustrated in FIG. 5.

Figure 2:
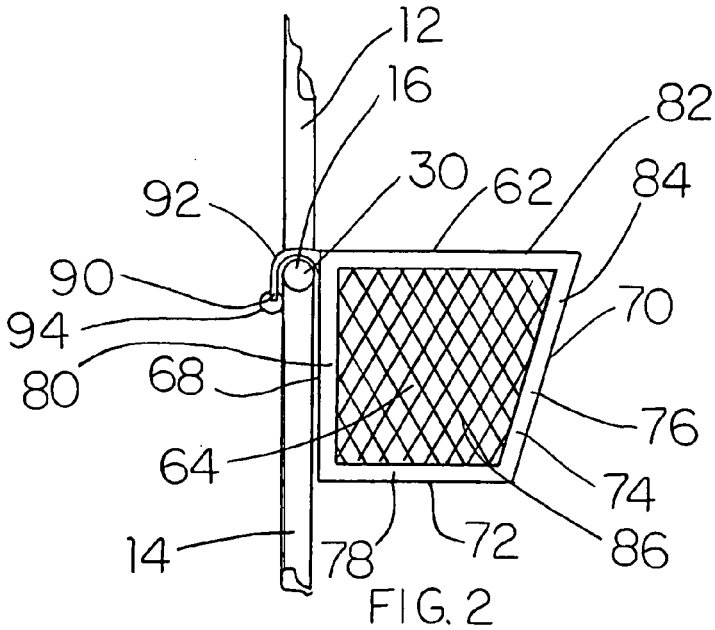
FIG. 2 is an end view of the new and improved pitcher screen of the invention.

Positioned on the exposed member 16 of top 30 of lower screen 14 is a ball basket 60 in which baseballs to be thrown by the pitcher may be stored. Basket 60 as shown in FIGS. 1, 2 and 3 has an open top 62 opposite ends 64, 66, a back 68, a front 70 and a bottom 72. In a specific embodiment, ends 64, 66 are shaped as a parallelogram. In another specific embodiment, front 70 is tapered outwardly from screen 10 as shown in FIG. 2 and ends 64, 66 are shaped as a trapezoid. Ends 64, 66 both have a peripheral frame formed of strip members connected end to end to form an end frame 76. Sheet material 34 is secured to spaced apart end frames 76 to form the basket 60. Members 74 include a bottom member 78 a back member 80 a top member 82 and a front member 84 each having opposite ends 86. These members are joined at their ends 86 to form a generally parallelogram peripheral end frame 76. Adhered to each end frame 76 and spanning therebetween is sheet material 88. Spanning between opposite spaced apart end frames 76 is a length of rigid sheet material 90 which is secured to end members 78, 80, and 84 thereby forming front 70, bottom 72 and back 68. Back 68 is extended beyond open top 62 and bent away from back 68 to form a downwardly facing hook 92 of a size to permit member 16 of lower screen 14 to be placed therein. Distal ends of sheet 90 are positioned in slotted tubes 94 to protect slant the ends.

Basket 60 in this form may be positioned on the member 16 of the top 30 of the lower screen 14. In the specific embodiment illustrated in the drawings, basket 60 extends substantially the entire length of the member 16 of the top 30 of the lower screen 14 between the pivotal connection of top screen 12 to lower screen 14 and the remote end of lower screen 14. In various specific embodiments, the members 74 may be made of galvanized steel, stainless steel, plastic or other materials of sufficient rigidity and strength. The sheet materials 88, 90 may be of any of the screen materials above-described.

In operation, the new and improved pitcher screen of the invention may be utilized to protect pitchers during batting practice. Both left handed and right handed pitchers may be protected without moving lower screen 14. To convert the screen from right handed pitching to left handed pitching all that is required is disengaging the latch 46 and pivotally rotating upper screen 12 with respect to lower screen 14 180° and lowering latch 46 to re-engage member 16 of top 30 of lower screen 12 to hold upper screen and lower screen in position. In both positions, basket 60 can be placed on the exposed top 30 of lower screen 14 to store balls to be used by the pitcher at a level which does not require the pitcher to bend over between pitches and pick up balls from the ground or from a ball bucket as conventionally used.

In the specific embodiment, the entire pitcher screen and basket 60 may be made of durable material such as galvanized steel or stainless steel or plastic such that the screen may be durable over a number of years and protected from the weather, corrosion and the like. Alternatively, all of the members 16 and sheet screen material 34, 88 may be plastic coated steel or plastic by which the screen may also be protected from weathering due to exposure of the elements.

The new and improved pitcher screen of the invention also utilizes durable screen material which need not be replaced during ordinary use for the life of the pitcher screen. This screen material may be less flexible than the conventional twine netting, the screen has sufficient flexibility to reduce the velocity of balls hitting the screen and yet stands weathering and the impact of the weather by exposure to the elements and the repeated impact of the balls and in normal use need not be replaced over the life of the screen.

While the specific embodiment of the invention has been shown and described herein for purposes of illustration, the protection offered by any patent which may issue upon this application is not strictly limited to the disclosed embodiment; but rather extends to all structures and arrangements which fall fairly within the scope of the claims which are appended hereto:

What is claimed is:

1. A pitcher's screen in combination with a ball basket comprising a lower screen having opposite ends, a base secured to said lower screen, an upper screen pivotally connected to said lower screen midway between said ends, said upper screen being movable in relation to said lower screen from adjacent one of said ends and in the same plane as said lower screen to adjacent the other of said ends and in the same plane as said lower screen, a latch engaging both said upper and lower screens for holding said screens in the same plane, and a ball basket removably connected to said lower screen remote from said upper screen, said ball basket hanging from said lower screen portion not covered by said upper screen, whereby both left handed and right handed pitchers may be protected during batting practice without moving said base and the balls may be conveniently stored.

2. The screen of claim 1 wherein said lower screen has a peripheral frame of metal, said peripheral frame comprising a metal member having opposite ends that have spaced apart bends therein and the opposite ends joined together to form a rigid rectangular flame defining a space there between.

3. The screen of claim 1 wherein said upper screen has a peripheral frame of metal, said peripheral frame comprising a metal member having opposite ends that have spaced apart bends therein and the opposite ends joined together to form a rigid rectangular frame defining a space there between.

4. The screen of claim 1 wherein said upper screen is approximately one-half the size of said lower screen.

5. The screen of claim 2 wherein said frame space is covered by a flexible screen.

6. The screen of claim 5 wherein said flexible screen is chosen from the group of flexible screens comprising window screens, woven wire screens, expanded metal screens, twine netting, and wire cloth.

7. The screen of claim 3 wherein said space is covered by a screen secured to said frame.

8. The screen of claim 7 wherein said screen is chosen from the group of flexible screens comprising window screens, woven wire screens, expanded metal screens, twine netting, and wire cloth.

9. The screen of claim 2 wherein said frame is chosen from the group of metal members consisting of galvanized steel, stainless steel, aluminum, plastic, reinforced plastic, fiberglass reinforced plastic, and plastic coated steel members.

10. The screen of claim 9 wherein said member is of a cross-sectional size from about one inch to about two inches.

11. The section of claim 3 wherein said frame is chosen from the group of metal tubes consisting of galvanized steel, stainless steel, aluminum, plastic, reinforced plastic, fiberglass reinforced plastic, and plastic coated steel members.

12. The screen of claim 3 wherein said member is of a cross-sectional size from about one inch to about two inches.

13. The screen of claim 3 wherein one of said member ends extends into contact with said member at a position spaced apart from the other of said member ends and is secured thereto, said one member end and the member portion extending therefrom forming the bottom of said upper frame, said other member end and the member portion extending therefrom forming the pivot pin of said upper frame.

14. The screen of claim 13 wherein said lower screen has a tubular bearing in which said pivot pin of said upper frame is journaled therein, said tubular bearing being secured midway between said opposite frame ends at the top of said frame, said tubular bearing extending generally perpendicularly of said top of said lower frame and generally vertically.

15. The screen of claim 1 wherein said latch comprises an upper split tubular portion that partially sounds the member of said upper frame and is movable generally vertically up and down of said upper frame, and a lower split tubular portion into which the top of said lower frame may be positioned.

16. The screen of claim 1 wherein said basket has opposite ends, an elongated rear side, an elongated front side, and a bottom.

17. The screen of claim 16 wherein said top portion of said rear side is radiused outwardly of said basket to form a hook, said hook receiving said top of said lower frame therein to allow said basket to hang from said top of said lower frame and be supported by said top of said lower frame within said hook and the engagement of a lower portion of said back side against said lower screen.

18. The screen of claim 17 wherein said front side tapers outwardly of said rear side forming an open top of said basket, said open top being larger in size and having a greater width than said bottom.

19. The screen of claim 16 wherein said basket ends are generally parallel to each other.

20. The screen of claim 17 wherein said basket ends have a peripheral metal frame, said frame being of a metal ribbon having a bottom, an upstanding back, a top, and a front defining a space therebetween, said therebetween space of said ends being covered by a metal screen secured to said end frames, said front side, rear side, and bottom being a single sheet of metal screen secured to said end frames, said metal screen sheet having opposite sides and opposite ends, said opposite sides being secured to said end frames, said opposite ends forming the top edge of said front side and said bottom edge of said hook.

21. The screen of claim 20 wherein said top edge and said bottom edge are enclosed in a slotted tubing extending between said end frames.

22. The screen of claim 1 wherein said upper screen is pivotally movable in relation to said lower screen about a pivotal axis which extends generally vertical.

23. The screen of claim 1 wherein said upper screen is pivotally movable in relation to said lower screen about a pivotal axis which extends generally horizontal.

24. The screen of claim 23 further comprising a pivot rod extending generally perpendicular of said upper screen, said pivot rod being journaled in a pair of brackets secured to said lower screen approximately midway between said opposite ends.

* * * * *